US007634958B2

(12) United States Patent
Baugher

(10) Patent No.: US 7,634,958 B2
(45) Date of Patent: Dec. 22, 2009

(54) ROTARY CUTTER

(76) Inventor: Robert C. Baugher, 2270 Canterbury Cir., Akron, OH (US) 44319

( * ) Notice: Subject to any disclaimer, the term of this patent is extended or adjusted under 35 U.S.C. 154(b) by 352 days.

(21) Appl. No.: 11/394,679

(22) Filed: Mar. 31, 2006

(65) Prior Publication Data

US 2006/0222467 A1 Oct. 5, 2006

(51) Int. Cl.
*B26D 1/18* (2006.01)

(52) U.S. Cl. ..... 83/483; 83/478; 83/490; 83/491; 83/485; 83/487; 83/698.41

(58) Field of Classification Search ..... 83/478, 83/490, 491, 483, 485, 487, 698.41; 242/526
See application file for complete search history.

(56) References Cited

U.S. PATENT DOCUMENTS 3,998,121 A * 12/1976 Bennett ..... 83/471.3
4,028,975 A * 6/1977 Bennett ..... 83/397
4,326,679 A * 4/1982 Phelps et al. ..... 242/526
5,557,997 A * 9/1996 Wunderlich et al. ..... 83/174
5,984,766 A * 11/1999 Gilmour ..... 451/211
6,295,910 B1 * 10/2001 Childs et al. ..... 83/698.11

* cited by examiner

*Primary Examiner*—Sang Kim
(74) *Attorney, Agent, or Firm*—Renner, Kenner, Greive, Bobak, Taylor & Weber

(57) ABSTRACT

A cutter for cutting elongate material into sections, the cutter including a motor coupled to a blade shaft, wherein said motor selectively rotates said blade shaft, a blade mounted on said blade shaft and rotatable therewith, and an actuator adapted to drive said blade along a drive axis toward the material.

10 Claims, 9 Drawing Sheets

ROTARY CUTTER

TECHNICAL FIELD

In general, the present invention relates to a cutter used to section elongate materials. More particularly, the present invention relates to a cutter having a rotating blade.

BACKGROUND OF THE INVENTION

The present invention generally relates to a cutter used to cut elongate products into sections. For example, the cutter may be used to cut extruded profiles with or without reinforcement. These materials have proven difficult to cut with existing cutters.

One existing cutter uses a curved blade that cuts through the material in a scythe like manner. This type of blade may be used to cut material as it comes off an extruder in a continuous manner. Unfortunately, the curved blade cutter often distorts the material as it cuts making it difficult to maintain dimensional accuracy. This distortion also may result in a defective cut surface that is scalloped or otherwise irregular. These problems are pronounced when cutting softer materials.

Another existing cutter operates in a lathe-like manner with the material being mounted inside a rotating mandrel. Since the mandrel has a finite length, extruded material must be pre-cut and mounted before additional cuts are made. Consequently, such cutters are not suitable for continuous operation.

SUMMARY OF THE INVENTION

The present invention generally provides a cutter for cutting elongate material into sections, the cutter including a blade motor having a blade shaft, a blade mounted on the blade shaft, and an actuator adapted to move the blade along a drive axis into contact with the material to cut the material.

The present invention further provides a cutter for cutting elongate material into sections, the cutter including a motor coupled to a shaft, wherein the motor selectively rotates the shaft, a blade mounted on the shaft and rotatable therewith, a guard enclosing the blade, the guard defining an opening for receiving the material, a guard shutter mounted adjacent the opening and moveable to selectively cover the opening, and an actuator attached to the guard shutter and adapted to move the guard shutter between an open position and a closed position.

The present invention further provides a cutter for sectioning elongated material, the cutter including a shaft rotatably supported by bearings and coupled to a motor, wherein the motor rotates the shaft, an arm supported on the shaft and extending radially outward relative to the shaft, the arm being rotatably fixed to the shaft and rotatable therewith, a blade mounted on the arm and rotatable independently of the arm, and a blade motor coupled to the blade and adapted to rotate the blade.

The present invention further provides a cutter for cutting elongate material into sections, the cutter including a blade motor having a blade shaft; a blade mounted on the blade shaft, wherein the blade motor is adapted to selectively rotate the blade at a selected speed to cut the material; wherein the blade is supported by an actuator adapted to move the blade into contact with the material to cut the material; and a winding assembly including a spool located downstream of the blade, the spool being adapted to gather the material, and a controller adapted to activate the actuator as the spool becomes full, driving the blade to cut the material.

DETAILED DESCRIPTION OF THE INVENTION

The cutter according to the present invention generally includes a blade that is rotated on its axis by a motor. The blade speed may be controlled according to the type of material that is being cut. As shown, the blade may be circular and is constructed of a suitable material, such as, a metal or ceramic material. Other materials may be used depending on the particular application. In one example, a surgical steel blade was found suitable for cutting through both soft materials and harder materials, including those containing Kevlar™ fibers. Optionally, a lubricant, such as water, soap, or air, may be applied to the blade to facilitate cutting.

A guard may be provided to reduce the likelihood of injury. The guard may include a slotted opening exposing a portion of the blade. The opening may include walls that guide the material into contact with the blade. A guard shutter may be used to limit exposure to the blade by selectively closing the opening when the blade is not cutting material providing further protection against inadvertent cutting. The shutter may be any member that is moveable to block or otherwise limit access to the opening. The shutter's movement may be controlled manually by a switch or trigger, or controlled automatically by a system controller depending upon the application.

Figure 1:
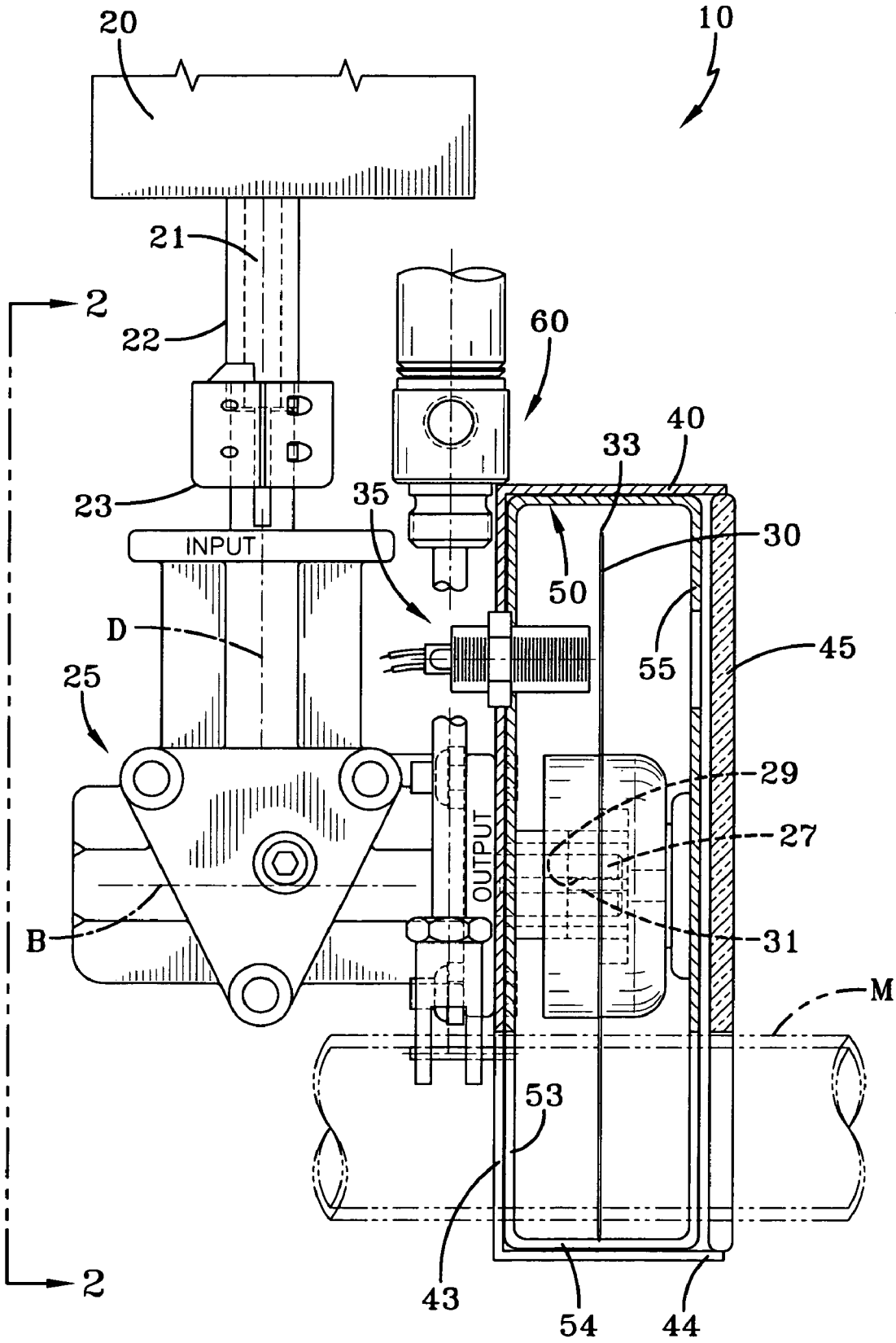
FIG. 1 is a partially sectioned side elevational view of a cutter according to the concepts of the present invention.

In the example shown in FIG. 1, a cutter according to the concepts of the present invention is generally indicated by the numeral 10. Cutter 10 includes a motor 20, which may be an electric motor, as shown, or any other conventional motor that causes the blade 30 to rotate.

Motor 20 has a drive shaft 21, which may be housed within a sleeve 22. The drive shaft 21 may connect to a gear box 25. In the example shown in FIG. 1, a collar 23 extends from the gear box 25 and receives the shaft 21. Drive shaft 21 may be slideably mounted within sleeve 22 and collar 23 to allow the cutter 10 to travel along the drive shaft axis D. It will be understood that gear box 25 is optional. The gear ratio created by gear box 25 may be used to improve motor torque. For example, a 2:1 reduction occurs in the depicted example. This particular gear ratio is not considered limiting, and it will be appreciated that other gear ratios may be used depending on the cutting application.

As shown in FIG. 1, the gear box 25 may be used to allow the blade 30 to rotate on a different axis than the axis of the motor's drive shaft. This axis may be parallel to the drive shaft 21 or at angle as shown. In the depicted embodiment, the gear box 25 creates a 90° angle between the drive shaft axis D and the blade axis B. This particular angle, however, is not considered limiting, and the relative angle between blade axis B and drive axis D may vary depending on the location of the cutter 10 relative to other components and the material M to be cut.

Blade 30 attaches to a blade shaft 27 that extends outward from gear box 25 along the blade's axis B. The blade 30 may be attached to blade shaft 27 in any known manner. In the example shown, the blade 30 includes key 31 that fits within a keyway 29 formed on blade shaft 27.

The blade 30, so connected, is rotated by the motor 20 at a selected speed based on the type of material M that is being cut. In the example shown, the blade 30 is circular having generally circular cutting edge 33 at its radial outward extremity. Other blade shapes suitable for rotary cutting may be used.

Figure 2:
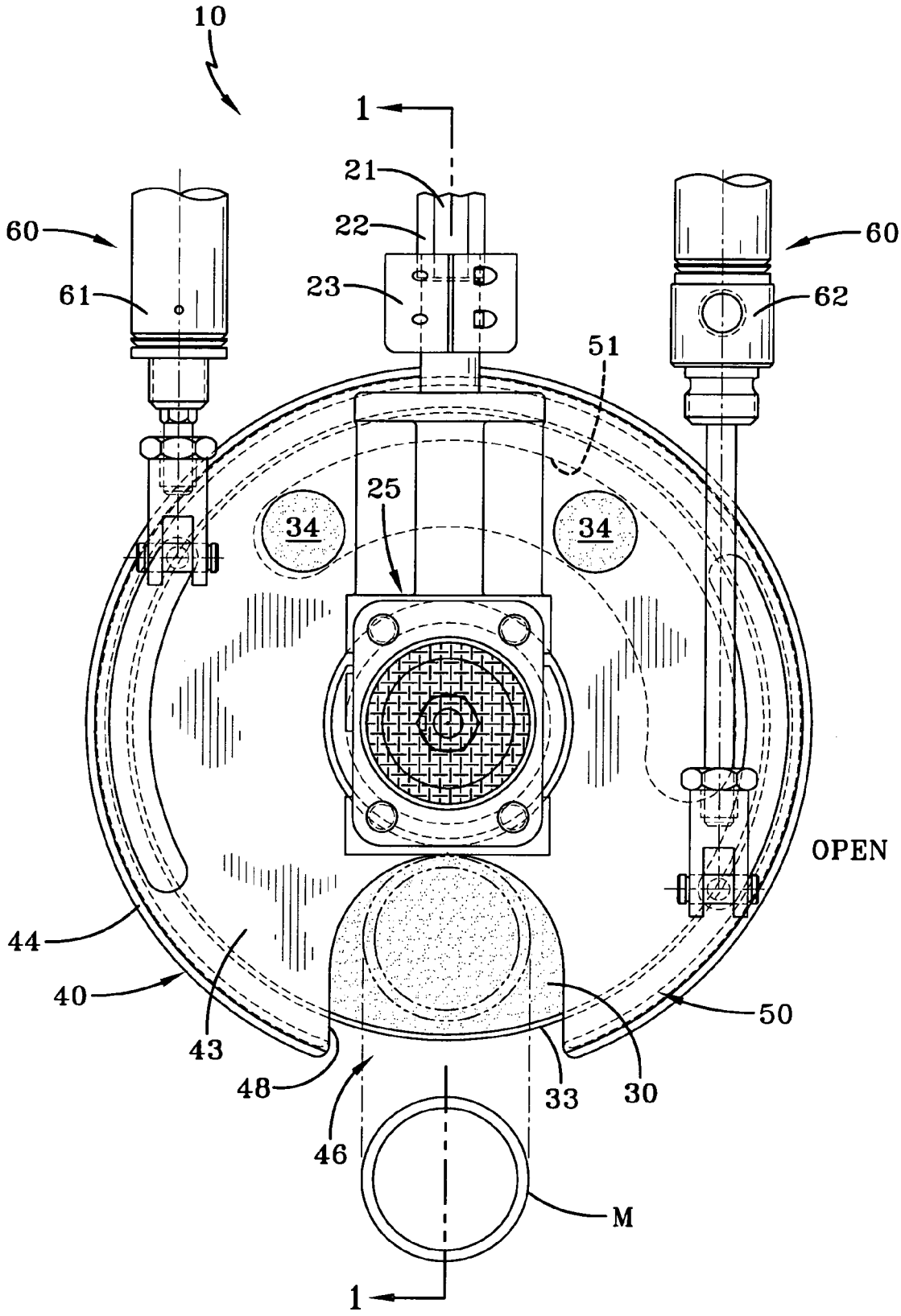
FIG. 2 is a top plan view of the cutter of FIG. 1 depicted with the guard shutter in an open position.
Figure 2A:
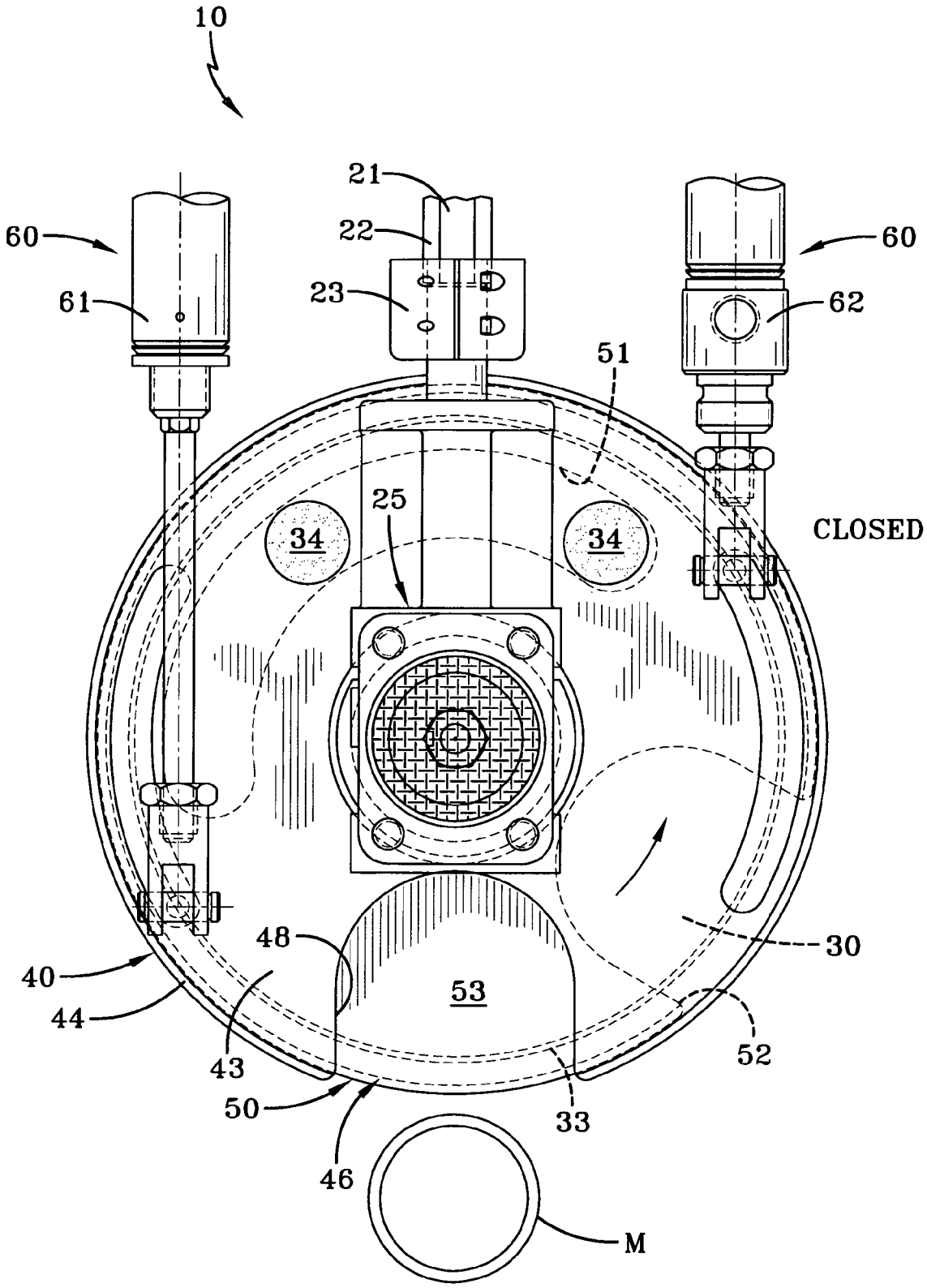
FIG. 2A is a top plan view of a cutter similar to the cutter shown in FIG. 2 with the guard shutter depicted in a closed position.

As discussed more completely below, the cutter 10 may carry a sensor in monitoring its operation. For example, a sensor 35 may be mounted is sensing relation to the blade 30 to monitor its operation. As will be appreciated, the sensor 35 may be used to generate various information including blade speed, number of revolutions, or simply to determine whether the blade 30 is rotating. In the depicted example, sensor 35 is used to visually check for a broken blade. A second sensor may be used in conjunction with sensor 35 to reduce the likelihood that a broken blade 30 would go undetected. To that end, the second sensor may be circumferentially spaced from sensor 35. In FIGS. 2 and 2A, openings 34 are provided in guard 40 to mount the sensors 35 and provide a line of sight to the blade 30.

As best shown in FIG. 1, guard 40 may include a plate 43, which may be attached to gear box 25, as by bolts. Plate 43 lies parallel to blade 30 on an inner side of blade 30. Guard 40 may further include a sidewall 44 that extends axially outward relative to plate 43 to cover the edge 33 of blade 30. To completely enclose blade 30, guard 40 may include a cover 45 opposite plate 43 on the outer side of blade 30. As shown, cover 45 may be removably attached against the guard 40 to cover the outer-side of blade 30 yet allow access to the blade 30 for repair and inspection purposes. As shown, the cover 45 may be made of a transparent or semi-transparent material, such as Lexan™ to allow visual inspection of blade 30.

An opening, generally indicated by the numeral 46, is formed in the guard 40 to expose a portion of the blade 30. While only the edge 33 of blade 30 may be exposed as by an opening in sidewall 44, opening 46 may extend radially inward to allow inward movement of material M relative to blade 30, as shown in FIG. 2. To that end, a slotted opening 46 may include slots 48 formed in plate 43 and cover 45 that extend radially inward from the radial outer extremity of a plate 43 and cover 45. The slotted opening 46 may be configured for a particular application. For example, the walls of slots 48 may have a profile that generally conforms to the profile of the material M being cut. As shown, a rounded slot surface may be useful when receiving material having a circular cross-section. To that end, opening 46 may generally conform to the material M being cut to serve as a guide and hold the material while it is being cut.

For improved safety, a guard shutter 50 may be provided to selectively close the opening 46. In the example shown, guard shutter 50 is rotatably mounted on guard 40 and may be rotated from a closed position (FIG. 2A), where the guard shutter 50 covers the opening 46 to an open position (FIG. 2) away from the opening 46. As shown, guard shutter 50 may have a somewhat C-shaped cross section (FIG. 1) including a guard plate 53 located within guard 40 on the inner side of blade 30, a guard sidewall 54 extending axially outward from guard plate 53 beyond the edge 33 of blade 30, and a lip 55 extending radially inward from guard sidewall 54 outside of blade 30. As shown, lip 55 may extend radially inward on the slot side to cover slots 48 formed in guard 40 to completely enclose edge 33 of blade 30. To prevent lip 55 from interfering with sensors 35, lip 55 may extend radially inward to a lesser extent to prevent the lip 55 from extending into the line of sight of sensor 35. This would prevent the sensor 35 from falsely reporting that the blade 30 was intact due to the lip 55 extending into its line of sight. As an alternative to shortening the extension of lip 55, openings may be provided in the lip 55 to ensure that it does not extend into the sensor's line of sight.

To accommodate sensors 35 that protrude inwardly from guard 40, guard shutter 50 may define a slot 51 that extends circumferentially a distance suitable for providing the necessary range of motion for the guard shutter 50 to rotate between the open position (FIG. 2) and the closed position (FIG. 2A). Also, the shutter 50 may define an opening 52 that corresponds to opening 46, so that opening 46 opens when the opening 52 in the guard shutter 50 is aligned with opening 46. Movement of the shutter 50 may be controlled by any known actuator or motor, which for simplicity will be generally referred to as an actuator and indicated by the numeral 60. In the example shown, actuator 60 includes a pair of pneumatic cylinders 61, 62 that attach to guard shutter 50 on opposite sides of guard shutter 50. The cylinders 61, 62 respectively push and pull shutter 50 to cause it to rotate in an alternating fashion to open and close the shutter 50. Two cylinders 61, 62 may be used to provide a measure of safety because guard shutter 50 will not open unless both cylinders 61, 62 are in operation.

Figure 3:
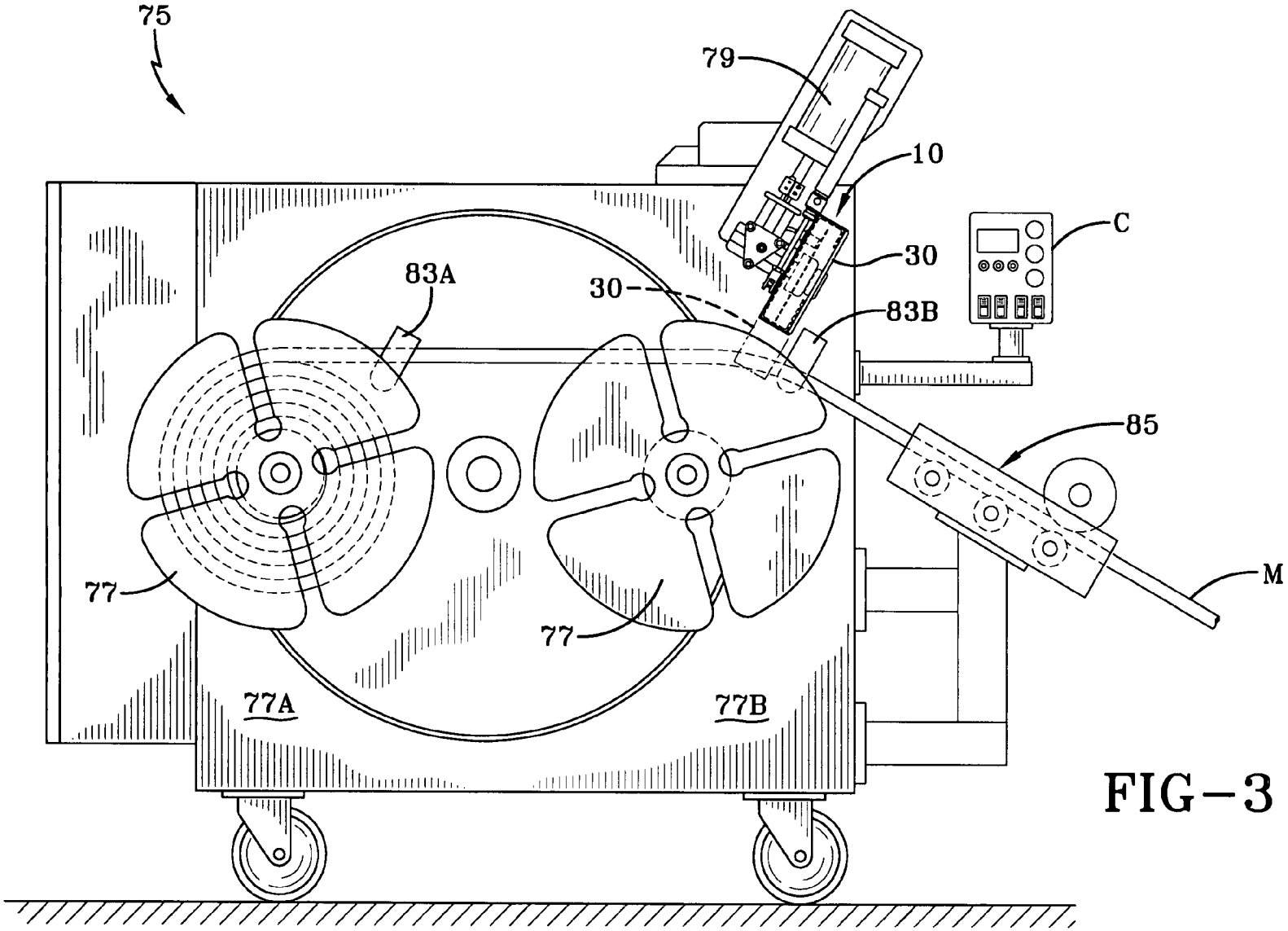
FIG. 3 is a front elevational view of a turret winding assembly having a cutter similar to the one depicted in FIG. 1.

In accordance with the concepts of the present invention, cutter 10 may be used in connection with a winding assembly, generally indicated by the number 75 in FIG. 3. Winding assembly generally includes a spool 77 that gathers material M in a continuous fashion until the spool 77 is full. At that point, cutter 10 may be driven toward a cutting position by an actuator 79, such as a pneumatic or hydraulic cylinder, to make a cut. To make the cut, the blade 30 is rotated and advanced to contact the material M at a selected angle. The rotating blade 30 may be driven through the material M by actuator 79. When using a guard 40, the opening 46 of guard 40 is aligned with material M, so that the material M is received within opening 46 while making the cut. To further improve the safety of the winding and cutting system, a shutter 50 may be used to selectively expose the blade 30 within opening 46. In this example, shutter 50 is opened as actuator 79 advances blade 30 toward material M allowing the material M to enter the opening 46 and be held by the walls of the slotted opening 48 as the blade 30 cuts through the material M. In the example shown, advancement of blade 30 is controlled by an air cylinder that drives gear box 25 and blade 30 along the drive shaft axis D. This actuator 79 also retracts blade 30 after the cut has been made allowing the material M to begin winding on a second spool. To facilitating cutting, a gripper 83 may be used to hold the material M as it is cut. Similarly, a traverse guide, generally indicated by the number 85, may orient the material M relative to the spool 77 to provide successive coils and align the material M with the gripper 83 in preparation for a cut.

It will be appreciated that the cut of material M gathered on spool 77 may be timed or a controller C in communication with spool 77 and actuator 79 may be used to detect a selected amount of material on the spool 77 and activate actuator 79 to make a cut. It will be appreciated that the selected amount of material M on spool 77 might not always coincide with the capacity of the spool 77. For sake of simplicity, however, this condition will generally be referred to as the spool being "full."

In the example shown, two spools 77 are mounted on a turret. In this way, once the first spool 77 is full it is rotated by the turret counterclockwise away from the cutter 10 to a cut/unload position 77A. At the same time, an empty spool rotated to a load position 77B adjacent to the cutter 10. In this position, the material M spans both spools 77 and the traverse guide 85 positions the material M in the path of the open gripper 83B on the empty spool. Then, in preparation for the cut, gripper 83B on empty spool grips material M just to the right of the cutter 10. At the time of the cut, the spool 77A stops winding and the gripper 83A on the full spool closes. To make the cut, as actuator 79 drives blade 30 toward material M, the motor brings the blade 30 up to speed and the guard shutter is opened so that the material M is received within the slot formed in the guard as the blade 30 cuts through material M. Once the cut is made, actuator 79 retracts the blade 30 and the guard shutter is closed. Controller C monitors the cutter to ensure that it is in a fully cleared position before spool rotation begins.

Meanwhile, after the cut, the operator may open the gripper 83A on the full spool 77 and removes full spool 77A from the turret. Then, an empty spool is placed on the spindle at the cut/unload position 77A. The process of turreting the spools 77 from the unload position 77A to the load position 77B continues making for a fully automatic winding and cutting system.

Figure 4:
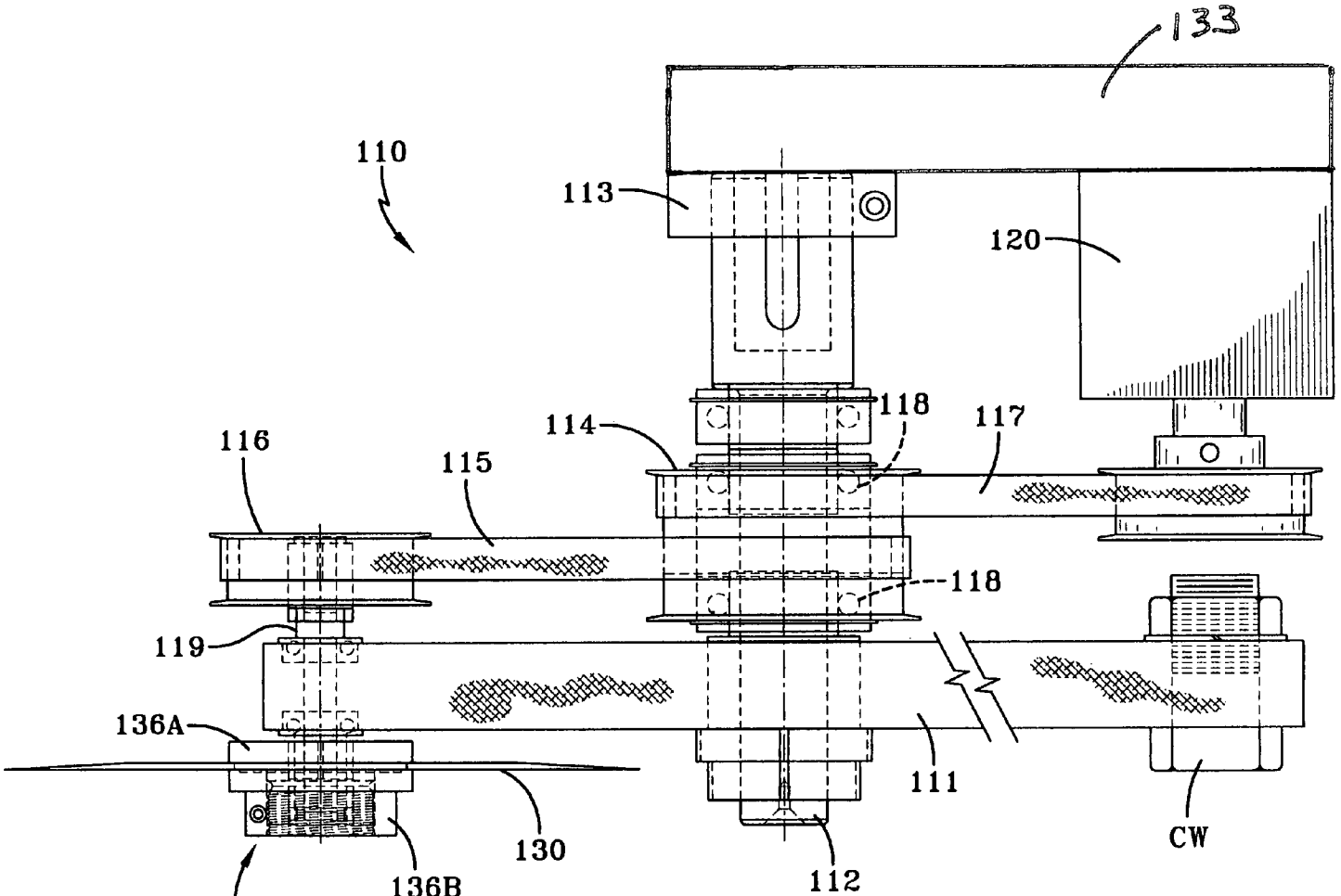
FIG. 4 is a top plan view of a first alternative cutter according to the concepts of the present invention.
Figure 5:
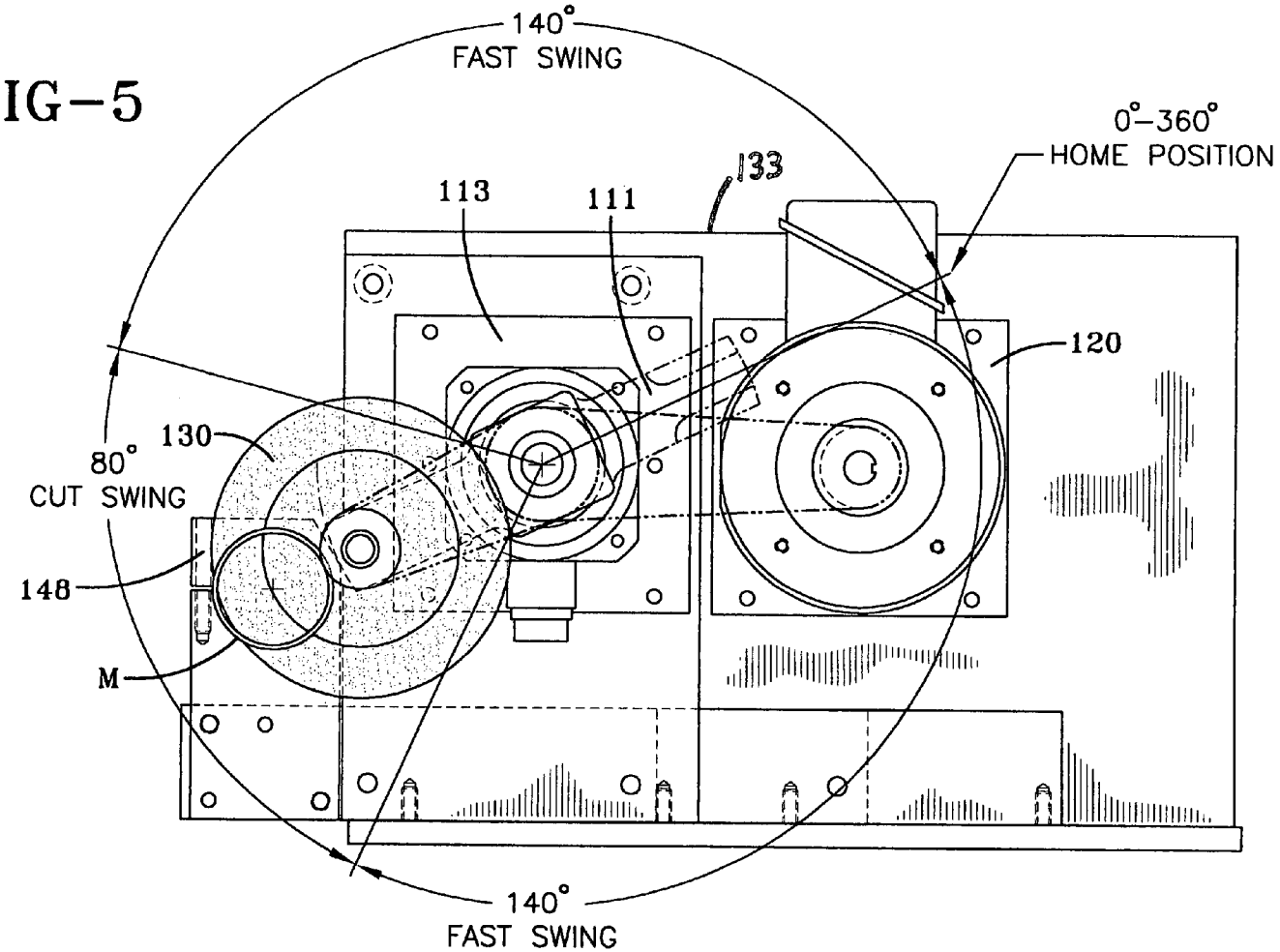
FIG. 5 is a front plan view of the cutter shown in FIG. 4.

An alternate cutter according to the concepts of the present invention is shown in FIGS. 4 and 5, and generally indicated by the numeral 110. Cutter 110, like cutter 10, includes a rotating blade 130, but differs in the method of bringing blade 130 into contact with material M. In this embodiment, blade 130 is mounted on a rotating arm 111. Rotating arm 111 rotates in a plane that intersects the material M (FIG. 4) and is used to periodically bring blade into contact with material M and make a cut. For cutting purposes, blade 130 may be caused to rotate independently of the arm 111. In the example shown, arm 111 is mounted on a shaft 112. The shaft 112 is rotatable and may be coupled to a motor 113. A floating gear 114 is also mounted on shaft 112 and supported by dual bearings 118 such that it is freely rotatable on the shaft 112. The floating gear 114 may be sized to accommodate two belts respectively connected to the blade 130 and motor 120. As depicted in FIG. 4, a belt 115 extends from the gear 114 to a gear 116 coupled to blade 130. A second belt 117 extends from the floating gear 114 to a blade motor 120 to drive the blade 130 independently of shaft 112. Notably, both the motor 113 and the blade motor 120 can be mounted to a stationary support 133, and the floating gear 114 and the belts 115, 117 permit the driving of blade 130 independently of shaft 112.

As shown, the blade pulley 116 and blade 130 may be mounted on opposite sides of the arm 111 with a shaft 119 connecting the blade 130 to the pulley 115. Blade shaft 119 may be supported in suitable bearings, as shown.

The blade 130 may be attached to blade shaft 119 in any known manner including the clamp assembly, generally indicated by the numeral 136 as shown. Clamp assembly 136 is keyed to blade shaft 119 such that it rotates therewith, and includes a chuck 136A on which the blade 130 is mounted. A portion of the chuck 136A extends through blade 130 and has a threaded end onto which a cap assembly 136B is attached to clamp the blade 130 in place. So clamped, blade motor 120 via the belts and pulleys causes the blade 130 to rotate independently of the arm 111.

As best shown in FIG. 5, an arm motor 113 rotates the arm 111 to bring the rotating blade 130 into contact with the material M. The speed of the arm 111 may be varied depending on the type of material M to ensure an accurate cut. To improve efficiency, arm speed is generally the fastest speed that still produces an accurate cut. To increase the maximum arm speed, lubricants including but not limited to water, soapy water, alcohol, and cold air may be used.

The speed of arm 111 may also be varied along its rotational path. For example the speed after a cut is made may be increased to bring the blade 130 to the cutting position in a shorter period of time and then slowed to the cut speed at the time of making the cut. In this way, more cuts may be made than when operating the arm 111 at a constant rotational speed. Also, an increase or decrease in the non-cut speed can be used to compensate for the change in speed caused by blade 130 cutting through material M, referred to as "cut dwell." The speeds and cut dwell may be measured in milliseconds (ms). For example, as schematically shown in FIG. 4, as the blade 130 approaches a cutting position, the arm 111 may be slowed to the speed needed to cut the material M. Moving the arm 111 too fast could cause an inaccurate cut, mar the cut surface, or damage blade 130. After the material M has been cut, for example when the blade 130 reaches a cleared position, the rotational speed of arm 111 may be increased to return the blade 130 to the cutting position. This phase of the arm's rotation is referred to as the "fast swing" in FIG. 5. To maintain proper cuts, a controller C accounts for the changes in the arm's speed going from the non-cut phase to the cutting phase, referred to as the "cut swing" of the arm's cycle in FIG. 5. The fast swing and cut swing phases may be defined by angular positions. In the example shown, the cut swing occupies an 80° segment located 140° from a home position located 180° opposite the center of the material M. After traveling through the cut swing, the arm rotated through the fast swing phase of approximately 280°. It will be appreciated that the cut swing and accordingly the fast swing will vary depending on the size of material M being cut. Therefore the angles shown for the cut swing and fast swing are not limiting. Also, any change in speed caused by blade 130 passing through material M may be accounted for by the controller C. With this information and the feed rate of the material M into cutter 110, the controller C rotates the arm 111 to cut the material into desired lengths.

One example cut cycle is described in FIG. 5. The example described is purely for illustration purposes and does not limit the invention. In this example, with the arm rotating at 200 rpm, one revolution equals 300 ms and the cut dwell is equivalent to 0.22 revolutions or 67 ms. The example follows with an explanation of the time and milliseconds for a given cut length, for example, 0.125 inches at a given cuts per minute speed. This speed is used to determine the feed rate and feet per minute.

The example further provides one cut cycle using the given example and discusses the coordination of the cutter 110 and the feeder (not shown). As described in the example, the part is selectively clamped and released as it is cut and then pulled away from the cutter 110 after the cut has been made. To that end, a guiding system may be provided for the exact placement of material. One guiding system includes a pair of arbors 148 split at the point of circular blade travel to support the product during the cutting process. The feeder may move material M at a speed and distance that is timed to provide the required cut length. As described, controller C may use a run/stop motion of the feeder and/or the arm 111 to achieve the desired cut length. As mentioned, the swing arm 111 can have varying speeds that may be independent of the cut window area. In this way, the cutter 110 can provide best cut quality at fast cut per minute rates for short parts, or for a long part, the arm 111 can be stopped until the required length is reached.

A counter weight CW may be attached to the arm 111 on the opposite side of blade 130. The amount of weight and radial position may be adjusted to counterbalance the blade 130.

The cutter 110 may be housed within a shroud to help protect the user and prevent foreign objects from interfering with the cutter's operation.

Figure 6:
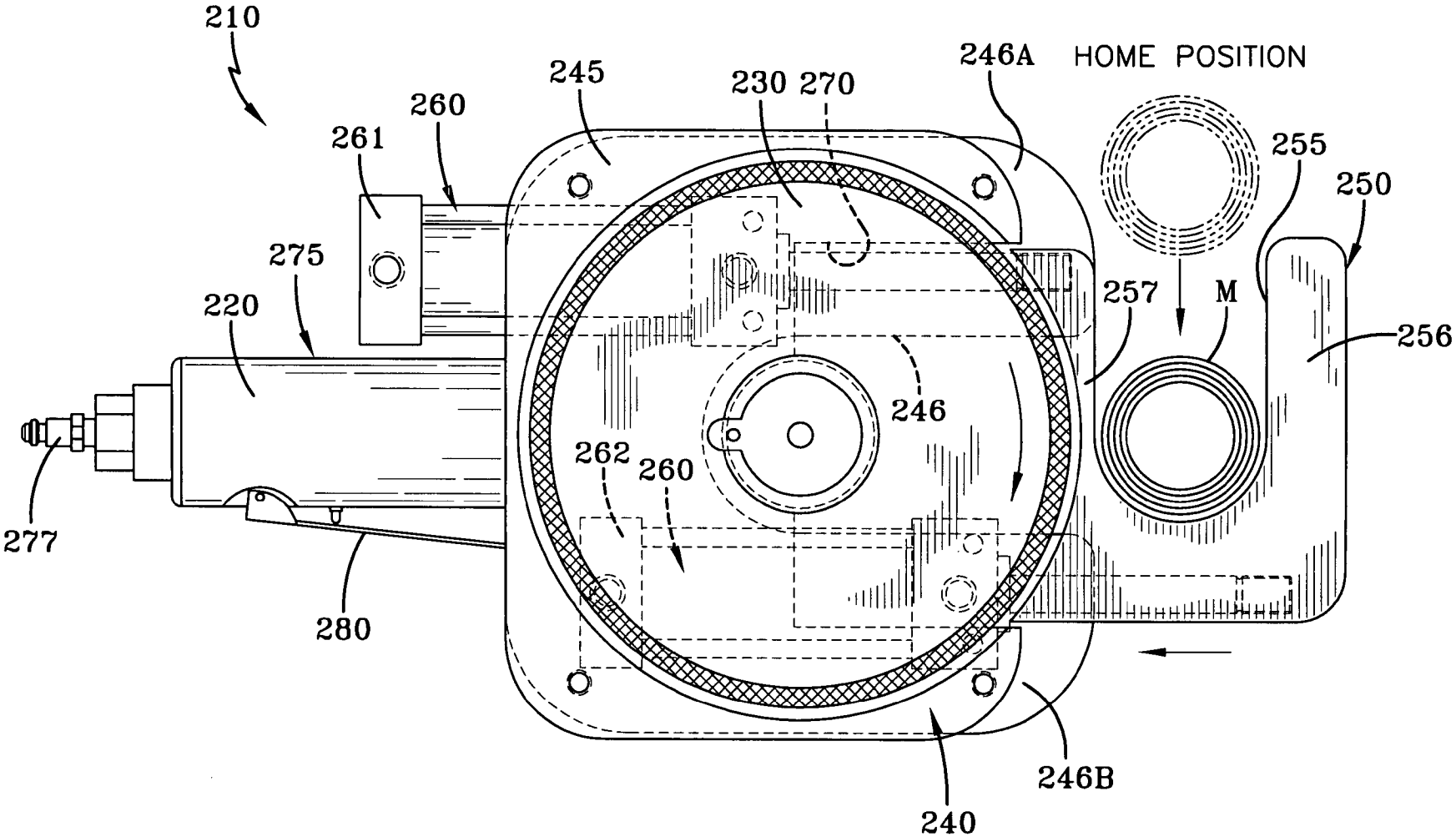
FIG. 6 is side elevational view of a second alternative cutter according to the concepts of the present invention shown in a non-cutting position.
Figure 7:
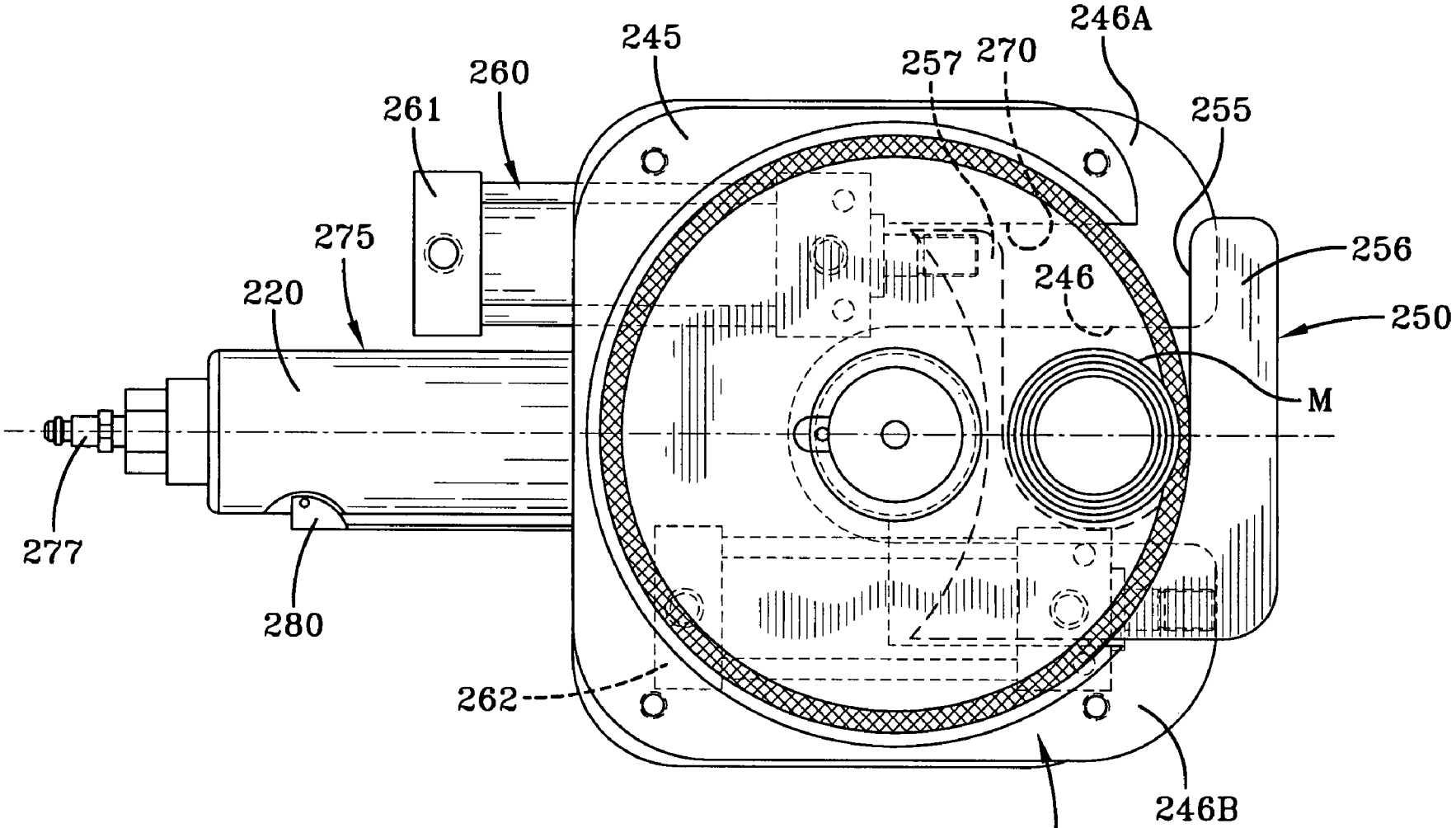
FIG. 7 is a side elevational view, similar to FIG. 6, with the cutter depicted in a cutting position.
Figure 8:
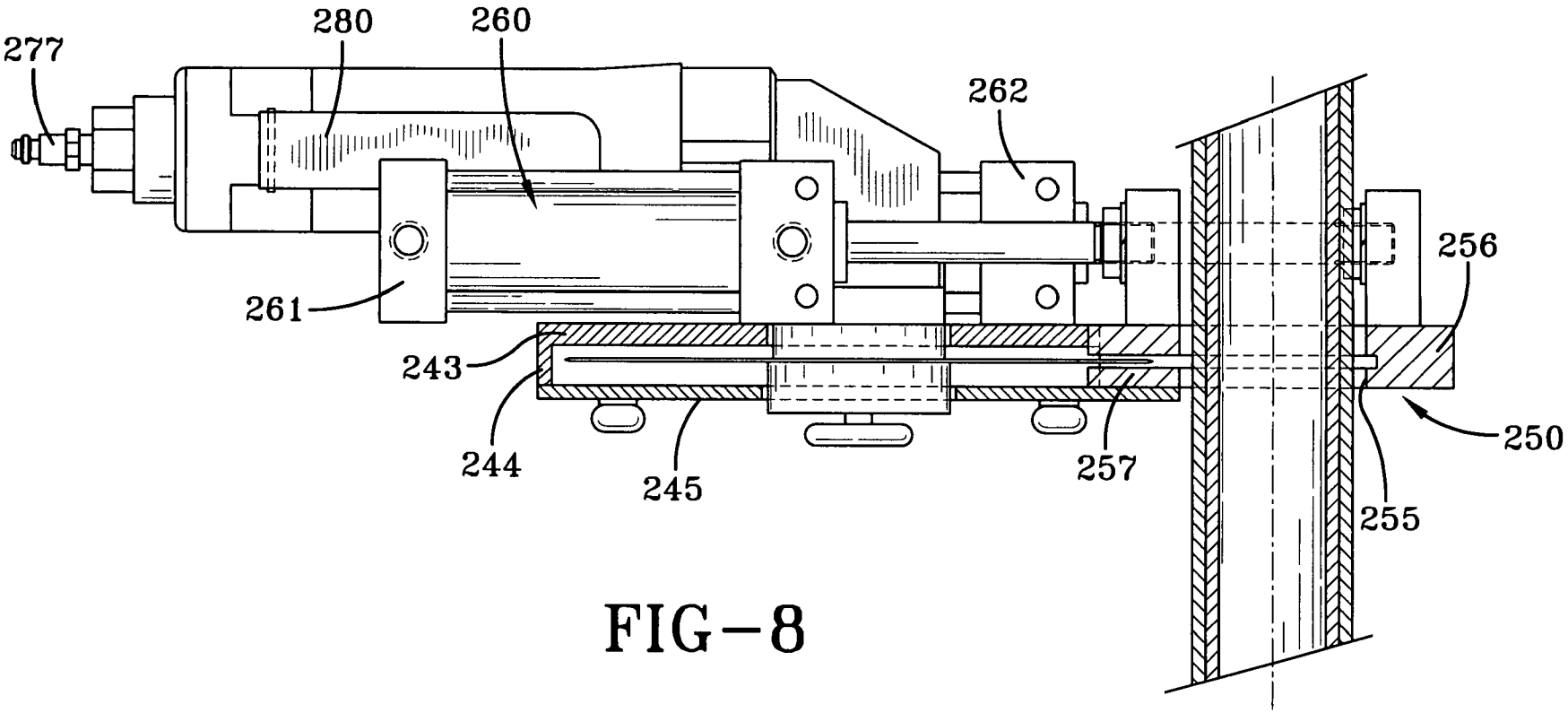
FIG. 8 is a top plan view of the cutter depicted in FIG. 6.

In another embodiment of the present invention, the cutter is incorporated in a hand-held device. For example, as shown in FIGS. 6-8, the cutter 210 may include a rotating blade 230 driven by a motor 220 as described in the previous embodiments. As will be appreciated motor 220 may be any type of motor including, for example, an air motor, as shown. In this embodiment, the motor 220 is incorporated as the handle 275 for the device. In the example shown, an air motor is used and a nozzle 277 is provided on the end of the handle 275 to connect the motor 220 to an air supply (not shown).

The cutter 210 may be provided with a guard 240 that generally surrounds the blade except for an opening 246 exposing a portion of the blade 230. As in the previous embodiment, guard 240 may include a cover 245 attached on one side of the guard 240. The cover may have walls 246*a*, 246*b* that define an elongated slot-like opening 246 for receiving material M. In the example shown, the opening 246 is formed opposite the handle 275.

As in the previous embodiment, guard shutter 250 may be provided to further protect the user from blade 230 and also to guide the material M into contact with blade 230. In the example shown in FIGS. 6-8, guard 240 defines a central recess 270 for receipt of a guard shutter 250 that defines a central slot 255. Central slot 255 may be oriented generally perpendicular to the centerline of handle 275. To prevent the user from contacting the blade 230, shutter 250 may be actuated by an actuator 260 that can be activated to draw guard shutter 250 inward causing the material M located within the shutter's slot 255 to contact the blade 230. As the first embodiment, actuator 260 may include a pair of air cylinders 261, 262 to draw the material M toward a cutting position. In this position, the outer leg 256 of guard shutter 250 generally closes opening 246 formed by guard 240. The inner leg 257 of guard shutter 250 also generally closes the opening 246 when guard shutter 250 is in an outwardly extended position (FIG. 6) reducing the likelihood of the user accidentally touching blade 230 at any time. Operation of guard shutter 250 and blade motor 220 may be controlled by a trigger 280 mounted on handle 275. For example, to cut material M, the user would locate the material M within the shutter's slot 255 and then depress the trigger 280 to start the blade's rotation and activate actuator 260 to draw the material M within the shutter 250 inward into contact with the blade 230 (FIG. 6). Release of the trigger 280 could cause the actuator 260 to drive the shutter 250 outward releasing the material M. Alternatively, the actuator 260 may pull the guard shutter 250 inward against the force of a spring (not shown) such that release of the trigger 280 would deactivate the actuator 260 allowing the spring to force the guard shutter 250 outward.

It will be appreciated that other guard shutters may be used including one similar to the shutter 50 described in the first embodiment in connection with cutter 210.

As can be seen from the above description, a novel cutter system has been shown and described. In accordance with the patent statutes, at least one embodiment of the present invention has been described. The embodiments discussed are for example purposes and do not limit the scope of the invention. For an appreciation of the scope of this invention, reference should be made to the appended claims.

The invention claimed is:

1. A cutter for cutting elongate material into sections as the elongate material is fed past a cutting plane, said cutter comprising:

a shaft rotatably supported by bearings and coupled to a shaft motor;

an arm supported on said shaft and extending radially outward relative to said shaft, said arm being fixed to said shaft and rotatable therewith, said shaft motor rotating said shaft and thereby rotating said arm;

a blade mounted on said arm and rotatable independently of said arm;

a blade motor coupled to said blade and adapted to rotate said blade, wherein said shaft motor rotates said arm repetitively through 360 degrees such that said blade mounted on said arm passes through the elongate material to cut a length of material therefrom, said blade cutting a length of material from the elongate material once during each rotation of 360 degrees; and a controller controlling the shaft motor and thereby controlling the speed of rotation of the arm through the 360 degrees of repetitive rotation.

2. The cutter of claim 1, wherein during a 360 degree rotation of said arm, said blade is brought to a cut position where said blade begins to cut through the elongate material, and said blade is further rotated through a cut swing sufficient to pass said blade through the elongate material and thus cut the elongate material.

3. The cutter of claim 2, further comprising: a winding assembly including a spool located downstream of said blade, said spool being adapted to gather the elongate material, wherein, when said spool becomes full, said controller drives said blade through said cut swing to cut the elongate material.

4. The cutter of claim 2, wherein said controller is adapted to rotate said arm at a non-constant speed.

5. The cutter of claim 4, wherein said controller is adapted to accelerate said arm after said blade cuts the elongate material to return said blade to said cut position, and said controller is adapted to decelerate said arm to a cut speed as said arm nears said cut position and travels through said cut swing.

6. The cutter of claim 1 further comprising a floating gear freely rotatable on said shaft, wherein said blade motor and said blade are coupled to said floating gear, wherein rotation of said floating gear by said blade motor causes said blade to rotate.

7. The cutter of claim 6 further comprising a first belt extending between said blade motor and said floating gear to couple said blade motor to said floating gear, and a second belt extending between said floating gear and said blade to couple said blade to said floating gear.

8. The cutter of claim 1 further comprising a blade shaft said blade shaft being rotatably supported on said arm, wherein said blade is mounted on said blade shaft by a clamp assembly, said clamp assembly including a chuck keyed onto said blade shaft and a cap attached to said chuck and adapted to clamp said blade therebetween.

9. The cutter of claim 8, wherein a threaded portion of said chuck extends through said blade, and wherein said cap is threadably attached to said chuck on said threaded portion to clamp said blade to said chuck.

10. The cutter of claim 1, wherein said shaft motor and said blade motor are mounted to a stationary support.

* * * * *